US006663202B2

(12) United States Patent
Spann

(10) Patent No.: US 6,663,202 B2
(45) Date of Patent: Dec. 16, 2003

(54) TRANSPORTABLE MEDICAL CART AND METHODS OF ASSEMBLY AND USE THEREOF

(75) Inventor: James T. Spann, Tampa, FL (US)

(73) Assignee: Promedica, Inc., Oldsmar, FL (US)

( * ) Notice: Subject to any disclaimer, the term of this patent is extended or adjusted under 35 U.S.C. 154(b) by 182 days.

(21) Appl. No.: 09/768,308

(22) Filed: Jan. 25, 2001

(65) Prior Publication Data

US 2002/0096845 A1 Jul. 25, 2002

(51) Int. Cl.[7] ..... A47B 49/00

(52) U.S. Cl. ..... 312/249.12; 312/241; 312/313; 312/334.8

(58) Field of Search ..... 312/240, 241, 312/249.11, 249.12, 249.13, 265.1, 265.2, 265.3, 265.4, 291, 301, 334.7, 334.8, 313; 16/18 CG; 292/175

(56) References Cited

U.S. PATENT DOCUMENTS

| | | | | | |
|---|---|---|---|---|---|
| 516,583 | A | * | 3/1894 | Adkins | 312/334.8 |
| 724,125 | A | | 3/1903 | Prindle | |
| 1,885,186 | A | * | 11/1932 | Defoy | 16/446 |
| 1,888,726 | A | * | 11/1932 | Jarvis et al. | 16/18 CG |
| 2,004,296 | A | | 6/1935 | Royce | |
| 2,260,586 | A | * | 10/1941 | Sheldon | 312/140.2 |
| 2,333,843 | A | * | 11/1943 | Cox | 312/334.12 |
| D163,013 | S | * | 4/1951 | Zeman | D6/430 |
| 2,661,258 | A | * | 12/1953 | Dinken | 312/248 |
| 3,087,767 | A | * | 4/1963 | Schell | 312/239 |
| 3,209,711 | A | * | 10/1965 | Pope | 108/152 |
| 3,415,561 | A | * | 12/1968 | Bryson et al. | 292/341.19 |
| 3,428,383 | A | | 2/1969 | Nobel | |
| 3,708,709 | A | | 1/1973 | Morrison et al. | |
| 3,834,778 | A | | 9/1974 | Morrison et al. | |
| 3,918,781 | A | | 11/1975 | Paris | |
| 4,286,831 | A | * | 9/1981 | Beers | 108/124 |
| 4,616,890 | A | | 10/1986 | Romick | |
| 5,011,240 | A | | 4/1991 | Kelley et al. | |
| 5,088,801 | A | * | 2/1992 | Rorke et al. | 312/184 |
| 5,129,715 | A | * | 7/1992 | Maynard, Jr. | 248/439 |
| 5,281,020 | A | | 1/1994 | Romick | |
| 5,302,014 | A | * | 4/1994 | Hobson | 312/249.12 |
| 5,306,077 | A | * | 4/1994 | Trevaskis | 312/122 |
| D357,781 | S | | 4/1995 | Crinion | |
| 5,472,270 | A | | 12/1995 | Czarnecky et al. | |
| 5,639,150 | A | * | 6/1997 | Anderson et al. | 312/265.2 |
| 5,673,983 | A | * | 10/1997 | Carlson et al. | 312/218 |
| 5,685,442 | A | * | 11/1997 | Yoshino et al. | 211/126.1 |
| 5,702,115 | A | * | 12/1997 | Pool | 280/47.35 |

FOREIGN PATENT DOCUMENTS

| | | | | |
|---|---|---|---|---|
| GB | 614730 | * | 12/1948 | |
| GB | 711970 | * | 7/1954 | |
| JP | 2001204552 A | * | 7/2001 | A47B/31/06 |

* cited by examiner

*Primary Examiner*—Lanna Mai
*Assistant Examiner*—John Fitzgerald

(57) ABSTRACT

A transportable medical cart includes a frame assembly and a plurality of panels removably mounted on the frame assembly including a horizontal top panel, a pair of side panels and a pair of extension panels. The side panels are movable from a retracted position wherein the side panels are disposed in parallel planes perpendicular to the top panel to a non-retracted position wherein the side panels are disposed at an angle to the planes. The extension panels are movable from a non-extended position wherein the extension panels overlap the side panels in the retracted position to an extended position wherein the extension panels are horizontally aligned with the top panel. The side panels in the non-retracted position support the extension panels in the extended position. A plurality of drawer assemblies are removably mounted to the frame assembly, each including a slide rail and a drawer supported on the slide rail.

8 Claims, 6 Drawing Sheets

TRANSPORTABLE MEDICAL CART AND METHODS OF ASSEMBLY AND USE THEREOF

BACKGROUND OF THE INVENTION

1. Field of the Invention

The present invention relates generally to transportable carts for medical use and, more particularly, to transportable case carts having drawers for holding medical supplies needed in a particular medical procedure or case and to methods of assembling and using transportable medical carts.

2. Brief Discussion of the Related Art

Transportable or mobile carts having casters or wheels are commonly used in medical settings, such as hospitals, for quickly and conveniently transporting medical supplies or equipment from place to place. To facilitate the mobility of transportable medical carts, it is desirable that the carts be structurally stable and conducive to being manually pushed and pulled. It is also desirable that transportable medical carts be capable of withstanding the rigors of hospital use, in which the carts may be bumped, jarred or otherwise forcefully impacted. Transportable medical carts typically must be sanitized for repeated use, and it is thusly desirable for the carts to be quickly and easily disassemblable for sanitization and quickly and easily reassemblable for reuse. Prior transportable medical carts, as represented in U.S. Pat. Nos. 5,281,020 and 4,616,890 to Romick, Nos. 3,834,778 and 3,3,708,709 to Morrison et al, and No. 3,428,383 to Nobel, possess complex or cumbersome hardware, making disassembly and reassembly of the carts tedious and time consuming. Furthermore, prior transportable medical carts possess structural seams which, in addition to exposed hardware, may trap dirt and germs and thusly compromise sanitization.

Medical carts and cabinets having slidable drawers have been proposed, as illustrated by U.S. Pat. No. 5,472,270 to Czarnecky et al, Nos. 5,281,020 and 4,616,890 to Romick, Nos. 3,834,778 and 3,708,709 to Morrison et al, No. 3,428, 383 to Nobel, and No. 724,125 to Prindle. Medical carts having slidable drawers are particularly advantageous since the drawers can be used to hold various medical supplies or equipment in an organized manner. Many, if not all, of the medical items needed for a particular medical procedure or case can be contained in a medical cabinet as discussed in the Czarnecky et al patent. The cabinet disclosed by Czarnecky et al is stationary, and it would be more desirable to provide all of the medical items needed for a particular medical procedure or case in the drawers of a transportable or mobile medical cart, which may be called a medical case cart. The medical procedure or case for which a medical case cart is provided can be enhanced by locating or storing the medical case cart proximate the site at which the medical procedure or case is expected to be performed. Accordingly, it is desirable for medical case carts to be designed with a relatively small "footprint" to minimize the physical space required for the carts and to permit storage of the carts in relatively small areas or spaces.

Medical carts and cabinets having removable drawers have been proposed, as exemplified in U.S. Pat. No. 5,472, 270 to Czarnecky et al, Nos. 5,281,020 and 4,616,890 to Romick, and No. 3,428,383 to Nobel. Carts and cabinets not specifically designed for medical use but having removable drawers have also been proposed, and are disclosed in U.S. Pat. No. 5,011,240 to Kelley et al and No. 3,918,781 to Paris.

A disadvantage associated with prior carts and cabinets having removable drawers is that the drawers are difficult to remove and replace, commonly requiring the manipulation or disengagement of mechanical components and/or awkward or complicated maneuvering of the drawers.

Another disadvantage of many prior transportable medical carts is that the carts fail to provide a sufficiently large support surface for use as an operating table to support medical equipment and/or to support a patient. U.S. Pat. No. 724,125 to Prindle discloses a medical cabinet that converts to an operating table. In order to implement the conversion, however, all objects must be removed from the top of the cabinet in order to permit pivoting of an extension that normally overlies the cabinet top. Also, the extension must be supported by an extraneous door hinged to a side wall of the cabinet. U.S. Pat. No. 3,428,383 to Nobel discloses a transportable medical cart having a hinged extension supportable by a hinged brace. U.S. Pat. No. 2,004,296 to Royce discloses a wheeled dining table having hinged side extensions supportable by slides, respectively, which are selectively extendable from and retractable within a chest or cabinet forming a central portion of the dining table. Des. 357,781 to Crinion discloses a mobile caddy having a side extension supported by a separate brace. Prior carts, cabinets, chests and caddies that are provided with hinged extensions are disadvantageous for the additional major structural support members required to support the extensions. Prior carts, cabinets, chests and caddies having hinged extensions are undesirable for use in a medical environment due to their structural and mechanical complexity, relatively greater number of parts, decreased ease of transportability and use, and inability to be sanitized to medical standards.

SUMMARY OF THE INVENTION

Accordingly, it is a primary object of the present invention to overcome the aforementioned disadvantages of prior transportable medical carts.

Another object of the present invention is to allow rapid conversion of a transportable medical cart to an operating table without the addition of any major structural support members.

A further object of the present invention is to convert a medical cart to an operating table via hinged extensions supportable by the side walls of the medical cart.

An additional object of the present invention is to facilitate disassembly and reassembly of a transportable medical cart.

The present invention also has as an object to facilitate removal and replacement of the slidable drawers of a medical case cart.

Yet another object of the present invention is to permit the slidable drawers of a medical case cart to be removed from the cart via a simple lifting motion of the drawers off of slide rails of the cart.

The present invention has as a further object to permit the slidable drawers of a medical case cart to be removed from the cart and thereafter replaced in the cart via a simple lowering motion of the drawers onto slide rails of the cart.

It is also an object of the present invention to enhance sanitization of a medical case cart to medical standards.

Some of the advantages of the present invention are that the medical cart can be assembled or disassembled in a matter of minutes, the medical cart has a small "footprint" and can be stored in a patient's hospital room, the medical cart is stable and can be easily wheeled from place to place, the medical cart is capable of sustaining impacts typically encountered in a hospital setting, the medical cart can be converted to an operating table without having to remove any objects from the top of the cart, no extraneous major structural members are required for supporting the extensions used to form the operating table since the extensions are supported by side walls, respectively, of the medical cart, no pivotal or other awkward or complicated movement of the drawers is required to remove the drawers from or to replace the drawers upon the slide rails, no mechanical components or hardware are required to be manipulated in order to remove the drawers from or to replace the drawers upon the slide rails, the drawers are provided with peripheral lips facilitating manual grasping thereof, the drawers can be rearranged within the medical cart, the medical cart can accept drawers of different vertical heights, the number of structural parts in the medical cart is minimized, the medical cart does not present any exposed hardware or seams which would interfere with the efficacy of medical sanitization, and the medical cart is durable to sustain repeated disassemblies, sanitizations and reassemblies.

These and other objects, advantages and benefits are realized in the present invention as generally characterized in a transportable medical cart including a wheeled frame assembly and a plurality of panels removably, pivotally mounted on the frame assembly. The frame assembly includes a plurality of interconnected uprights and cross members defining an interior within which a plurality of drawer assemblies are mounted. The removable, pivotally mounted panels include a pair of vertical side panels and a pair of extension panels. The side panels have a retracted position in which the side panels are disposed on opposite sides of the frame assembly in parallel planes, respectively, perpendicular to a horizontal top panel of the frame assembly. The extension panels are pivotally mounted on the frame assembly and have a non-extended position in which the extension panels are disposed vertically over the side panels, respectively, in the retracted position. The extension panels are movable from the non-extended position to an extended position in which the extension panels are horizontally aligned with the top panel to form an operating table. The side panels are pivotally mounted on the frame assembly for movement from the retracted position to a non-retracted position in which the side panels are disposed outwardly of the frame assembly at an acute angle to the parallel planes, respectively, to support the extension panels in the extended position. When the side panels are moved to the non-retracted position, they are automatically releasably locked to the corresponding extension panels in the extended position via securing mechanisms, respectively.

Each drawer assembly includes a slide rail removably supportable on a cooperating pair of guide rails of the frame assembly and a drawer removably supportable by gravity on the slide rail. The slide rail includes a pair of parallel side rails connected by a cross rail and having bearing bosses protruding laterally outwardly therefrom, respectively. The bearing bosses of the side rails are removably insertable in guide channels of the cooperating pair of guide rails, respectively, and are slidable in the guide channels to slidingly mount the slide rail. Each drawer includes a pair of shoulders on opposite sides thereof, respectively, supportable by gravity on the side rails, respectively. The slide rails are slidable with the drawers, respectively, relative to the frame assembly from a fully inserted position wherein the drawers are disposed within the interior to a fully withdrawn position wherein the drawers are disposed externally of the interior. When the slide rails and drawers are in the fully withdrawn position, the drawers can be removed from the slide rails via a simple vertical lifting motion and can be replaced upon the slide rails via a simple lowering motion.

A method of assembling a transportable medical cart according to the present invention is generally characterized in the steps of releasably engaging a top panel hinge part on a top panel with a top panel complementary hinge part on a frame assembly to removably mount the top panel on the frame assembly, the frame assembly including a plurality of interconnected uprights and cross members defining an interior and a caster at a lower end of each upright; pivoting the top panel about the releasably engaged top panel and top panel complementary hinge parts to lie horizontally over a top of the frame assembly perpendicular to a back panel of the frame assembly; releasably engaging side panel hinge parts on a pair of side panels, respectively, with side panel complementary hinge parts, respectively, on the frame assembly to removably mount the side panels on the frame assembly; pivoting the side panels about the releasably engaged side panel and side panel complementary hinge parts to lie vertically over opposite sides, respectively, of the frame assembly perpendicular to the top panel; releasably engaging extension panel hinge parts on a pair of extension panels, respectively, with extension panel complementary hinge parts, respectively, on the frame assembly to removably mount the extension panels on the frame assembly; pivoting the extension panels about the releasably engaged extension panel and extension panel complementary hinge parts to lie vertically over the side panels, respectively, substantially perpendicular to the top panel and substantially parallel with the side panels, respectively; removably mounting a plurality of slide rails in the interior of the frame assembly for horizontal sliding movement; and supporting a plurality of drawers on the slide rails, respectively, for movement with the slide rails between fully inserted and fully withdrawn positions.

A method of converting a transportable medical cart to an operating table is generally characterized in the steps of pivoting left and right extension panels of a transportable medical cart upwardly from a non-extended position wherein the left and right extension panels are disposed vertically over parallel left and right side panels, respectively, of the transportable medical cart, to an extended position wherein the left and right extension panels are disposed in horizontal alignment with a horizontal top panel of the transportable medical cart; pivoting the left and right side panels outwardly from the frame assembly to support the left and right extension panels, respectively, in the extended position; and releasably locking the left and right side panels to the left and right extension panels, respectively, in the extended position.

Other objects and advantages of the present invention will become apparent from the following description of the preferred embodiments taken in conjunction with the accompanying drawings, wherein like parts in each of the several figures are identified by the same reference numerals or by reference numerals having the same last two digits.

DESCRIPTION OF THE PREFERRED EMBODIMENT

Figure 2:
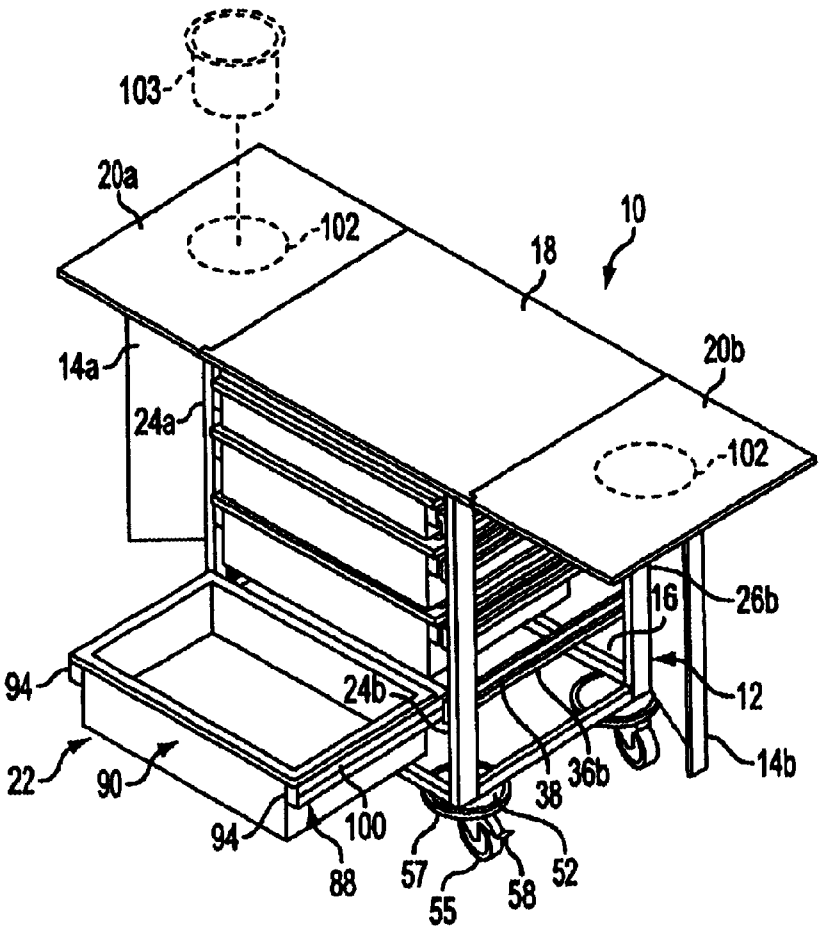
FIG. 2 is a front perspective view of the transportable medical cart converted to an operating table and illustrating a lowermost drawer of the cart in a fully withdrawn position.
Figure 1:
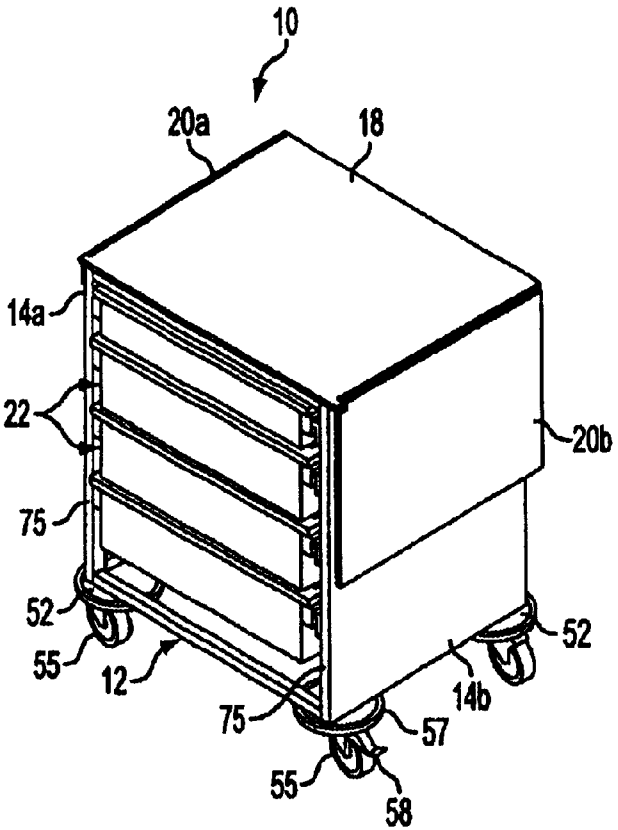
FIG. 1 is a front perspective view of a transportable medical cart according to the present invention.
Figure 3:
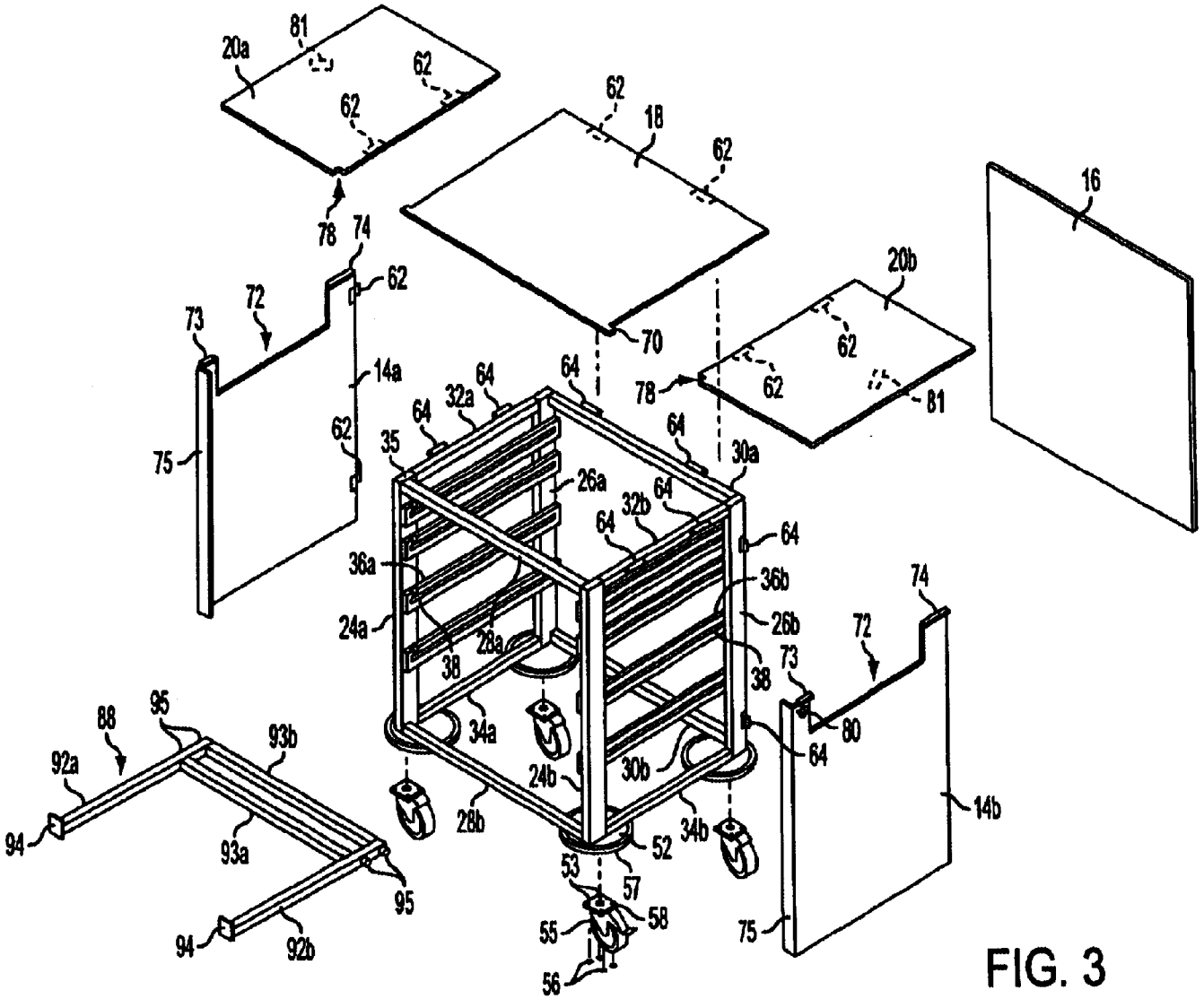
FIG. 3 is an exploded, front perspective view of the transportable medical cart without the drawers therefor being shown.

A transportable medical cart 10 according to the present invention is illustrated in FIGS. 1 and 2 and includes a frame assembly 12, a plurality of panels or walls comprising a left side panel 14*a*, a right side panel 14*b*, a top panel 18, a left extension panel 20*a* and a right extension panel 20*b* removably mounted on frame assembly 12, and a plurality of drawer assemblies 22 supported for sliding movement by frame assembly 12. As best shown in FIG. 3, frame assembly 12 includes a back panel 16, four parallel uprights, i.e. a left front upright 24*a*, a right front upright 24*b*, a left back upright 26*a* and a right back upright 26*b* having upper and lower ends, respectively, an upper front cross member 28*a* extending perpendicularly between the upper ends of the left front and right front uprights 24*a* and 24*b*, a lower front cross member 28*b* extending perpendicularly between the lower ends of the left front and right front uprights 24*a* and 24*b*, an upper back cross member 30*a* extending perpendicularly between the upper ends of the left back and right back uprights 26*a* and 26*b*, a lower back cross member 30*b* extending perpendicularly between the lower ends of the left back and right back uprights 26*a* and 26*b*, an upper left or lateral cross member 32*a* extending perpendicularly between the upper ends of the left front and left back uprights 24*a* and 26*a*, a lower left or lateral cross member 34*a* extending perpendicularly between the lower ends of the left front and left back uprights 24*a* and 26*a*, an upper right or lateral cross member 32*b* extending perpendicularly between the upper ends of the right front and right back uprights 24*b* and 26*b*, and a lower right or lateral cross member 34*b* extending perpendicularly between the lower ends of the right front and right back uprights 24*b* and 26*b*. The upper front and lower front cross members 28*a* and 28*b* are parallel to one another and to the upper back and lower back cross members 30*a* and 30*b*, which are perpendicular to the upper left and lower left cross members 32*a* and 34*a*. The upper right and lower right cross members 32*b* and 34*b* are parallel to the upper left and lower left cross members 32*a* and 34*a*. The upper and lower ends of the uprights are rigidly secured to the corresponding ends of the cross members to define an open front for the frame assembly between the front uprights and, more particularly, circumscribed by the left front upright, the right front upright, the upper front cross member and the lower front cross member. The back panel 16 is attached to the back uprights and back cross members and defines a closed back for the frame assembly as described further below.

The uprights are preferably made of one inch by two inch by 0.125 inch aluminum tubing, and the cross members are preferably made of one inch by one inch by 0.125 inch aluminum tubing. The ends of the tubing which form the upper ends of the uprights are closed by end caps 35, respectively. In a preferred embodiment, the uprights have a length of about 29.75 inches between the upper and lower ends, the front and back cross members have a length of about 25 inches between the corresponding left and right uprights, and the left and right cross members have a length of about 17.5 inches between the corresponding front and back uprights. The ends of the cross members are secured to the corresponding uprights by welding to avoid the presence of hardware and seams.

A plurality of left guide rails 36*a* have forward and rearward ends, respectively, secured to the left front and left back uprights 24*a* and 26*a*, respectively. A plurality of right guide rails 36*b* have forward and rearward ends, respectively, secured to the right front and right back uprights 24*b* and 26*b*, respectively. The forward ends of the left and right guide rails 36*a* and 36*b* do not protrude forwardly beyond planar forward faces or surfaces of the left front and right front uprights 24*a* and 24*b*, respectively. The rearward ends of the left and right guide rails 36*a* and 36*b* do not protrude rearwardly beyond planar rearward faces or surfaces of the left back and right back uprights 26*a* and 26*b*, respectively. The forward and rearward ends of the left guide rails 36*a* are mounted on planar inner faces or surfaces of the left front and left back uprights 24*a* and 24*b*, respectively. The forward and rearward ends of the right guide rails 36*b* are mounted on planar inner faces or surfaces of the right front and right back uprights 24*b* and 26*b*, respectively. The left guide rails 36*a* are parallel to the upper left and lower left cross members 32*a* and 34*a*. The right guide rails 36*b* are parallel to the upper right and lower right cross members 32*b* and 34*b*. Each left guide rail 36*a* cooperates with a corresponding right guide rail 36*b* to form a cooperating pair of guide rails which cooperate to support or suspend a drawer assembly as explained further below. The cooperating pairs of guide rails are mounted at vertically spaced locations along the uprights in accordance with the drawer height to be accommodated between vertically spaced cooperating pairs of guide rails.

In the preferred embodiment, the left and right guide rails are made from two inch by one half inch aluminum plate having a length of about 21.5 inches between the forward and rearward ends thereof. The forward and rearward ends of the left and right guide rails are welded to the front and back uprights, respectively, to avoid the presence of hardware and seams, the guide rails preferably being welded to the planar inner faces or surfaces of the front and back uprights. The forward ends of the left and right guide rails are flush with or are disposed close to the planar forward faces or surfaces of the front uprights, respectively. The rearward ends of the left and right guide rails are flush with or are disposed close to the planar rearward faces or surfaces of the back uprights, respectively.

Figure 4:
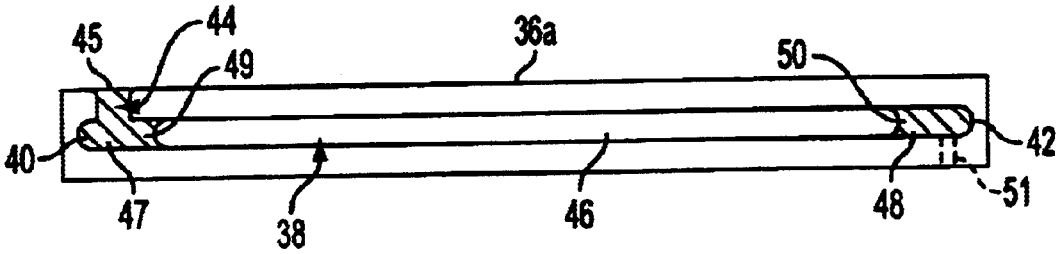
FIG. 4 is side view of a guide rail for the transportable medical cart.

Each guide rail has a longitudinal guide channel 38 therein facing the interior of the frame assembly and having a central longitudinal axis centrally disposed between top and bottom faces or surfaces of the guide rail. As shown in FIG. 4 for a left guide rail 36*a*, the guide channel 38 terminates at an arcuate forward end 40 near the forward end of the guide rail and at an arcuate rearward end 42 near the rearward end of the guide rail. The forward and rearward ends 40 and 42 define forward and rearward end stops or abutments, respectively, limiting forward and rearward travel of a drawer assembly supported on a cooperating pair of guide rails as explained further below. The guide channel 38 communicates with an insertion passage 44 extending upwardly from the guide channel 38 near its forward end 40 and by which a bearing boss of the drawer assembly is positioned in the guide channel as described below in greater detail. The insertion passage 44 extends upwardly from the guide channel 38 in a direction perpendicular to the central longitudinal axis of the guide channel and terminates at a flared mouth 45 along the top surface of the guide rail to facilitate insertion of the bearing boss, which is lowered into the insertion passage 44 via the flared mouth 45. When the guide rails are secured to the uprights, the guide channels 38 extend parallel to the left and right cross members, and the vertical spacing between the guide channels is sufficient to accommodate a drawer assembly having a drawer of desired height between vertically spaced cooperating pairs of guide rails.

Each guide channel 38 includes a central length segment 46, a forward length segment 47 extending forwardly from the central length segment, and a rearward length segment 48 extending rearwardly from the central length segment as shown in FIG. 4 for a left guide rail 36*a*. The guide channel 38 extends through the entire thickness of the guide rail 36*a* along the central length segment 46, but extends through less than the entire thickness of the guide rail 36*a* along the forward and rearward length segments 47 and 48, the thickness of the guide rail being defined between inner and outer side faces or surfaces of the guide rail. Along the central length segment, therefore, the guide channel has a depth corresponding to the thickness of the guide rail. Along the forward and rearward length segments, the guide channel 38 extends part-way through the thickness of the guide rail, from the inner surface of the guide rail to relatively thin outer side wall portions 49 and 50, respectively, of the guide rail. Accordingly, the guide channel has a depth along the forward and rearward length segments corresponding to the distance from the inner surface of the guide rail to the outer side wall portions, respectively, which is less than the depth of the guide channel along the central length segment. The outer side wall portions 49 and 50 define forward and rearward internal bearings, respectively, which releasably retain a slide rail of a drawer assembly in fully withdrawn and fully inserted positions, respectively, as explained further below. A drain hole 51, shown in dotted lines in FIG. 4, extends from the guide channel 38 to the bottom surface of the guide rail 36*a* to facilitate water drainage when the cart is washed.

In the preferred embodiment, the guide channels are centered between the forward and rearward ends of the guide rails and have a length of about 21.00 inches between the guide channel forward and rearward ends and a height of about 0.633 inch. The insertion passage has a length of about 0.750 inch parallel to the length of the guide channel and is located about 0.750 inch rearwardly of the forward end of the guide rail. The forward end of the guide channel is located forwardly of the insertion passage. The depth of the guide channel along the forward and rearward length segments is about 0.063 inch less than the depth of the guide channel along the central length segment.

It should be appreciated that the frame assembly can include any number of cooperating pairs of guide rails depending on the number of drawer assemblies desired to be supported in the transportable medical cart. In the preferred embodiment, four cooperating pairs of guide rails capable of supporting four drawer assemblies, respectively, are provided as shown in FIGS. 1 and 2. An uppermost cooperating pair of guide rails is spaced vertically a minimal distance below the upper cross members. An upper intermediate cooperating pair of guide rails is spaced vertically below the uppermost cooperating pair of guide rails to allow a drawer assembly including a drawer four inches in height to be supported by the uppermost cooperating pair of guide rails, with there being a minimal vertical gap or space between a bottom of the four inch high drawer and the top of a drawer supported by the upper intermediate cooperating pair of guide rails. A lower intermediate cooperating pair of guide rails is spaced vertically below the upper intermediate cooperating pair of guide rails so that the upper intermediate cooperating pair of guide rails can support a drawer assembly having a drawer six inches in height, with there being a minimal vertical gap or space between the bottom of the six inch high drawer and the top of a drawer supported by the lower intermediate cooperating pair of guide rails. A lowermost cooperating pair of guide rails is spaced vertically below the lower intermediate cooperating pair of guide rails such that the lower intermediate cooperating pair of guide rails can support a drawer assembly having a drawer six inches in height, with there being a minimal vertical gap or space between the bottom of this six inch high drawer and the top of a drawer supported by the lowermost cooperating pair of guide rails. The lowermost cooperating pair of guide rails is spaced vertically above the lower cross members a sufficient distance to support a drawer assembly having a drawer ten inches in height with there being a minimal vertical gap or space between the bottom of the ten inch high drawer and the lower cross members.

In the preferred embodiment, the central longitudinal axes of the guide channels of the uppermost cooperating pair of guide rails are located about 3.875 inches below upper faces or surfaces of the upper cross members, the central longitudinal axes of the guide channels for the upper intermediate cooperating pair of guide rails are located about 7.875 inches below the upper surfaces of the upper cross members, the central longitudinal axes of the guide channels for the lower intermediate cooperating pair of guide rails are located about 14.375 inches below the upper surfaces of the upper cross members, and the central longitudinal axes of the guide channels for the lowermost cooperating pair of guide rails are located about 20.937 inches below the upper surfaces of the upper cross members.

Planar caster pads 52 having a circular configuration are welded to the lower ends of the uprights, respectively. The caster pads 52 are made of aluminum and have a diameter of about 7.0 inches in the preferred embodiment. As best shown in FIG. 3, the lower ends of the uprights are positioned off-center to the caster pads 52, respectively, so that the caster pads protrude forwardly from the left and right front uprights and protrude rearwardly from the left and right back uprights about 1.0 inch, and protrude laterally from the left front and left back uprights about 2.0 inches to the left and from the right front and right back uprights about 2.0 inches to the right. Each caster pad 52 has a plurality of pins(not visible in FIG. 3) protruding downwardly therefrom for insertion through respective holes 53 in mounting plates 54 of casters 55. Nuts 56 are used to threadably engage ends of the pins protruding downwardly through the holes 53 to secure the casters 55 to the caster pads 52. Of course, in the alternative, the casters can be welded to the caster pads.

Each caster pad is preferably provided with a circumferential bumper 57, preferably made from an impact-absorbing or shock-absorbing material such as rubber. Each caster includes a wheel capable of swiveling or rotating, the casters 55 allowing the frame assembly 12 to be manually transported or wheeled from place to place in an efficient manner. One of the casters is provided with a foot actuatable lock 58 for selectively, releasably locking the caster in a fixed position so that the cart is held in place. The caster pads function as an "umbrella" for the associated casters, shielding the casters from environmental fluids or debris.

The back panel 16 is planar; and, in the preferred embodiment, is an aluminum panel having a height of about 29.75 inches, a width of about 27 inches and a thickness of about 0.080 inch. The back panel covers the space circumscribed by the left back upright, the right back upright, the upper back cross member and the lower back cross member; and, in the preferred embodiment, the back panel is welded to the back uprights and back cross members so as not to be removable.

Figure 5:
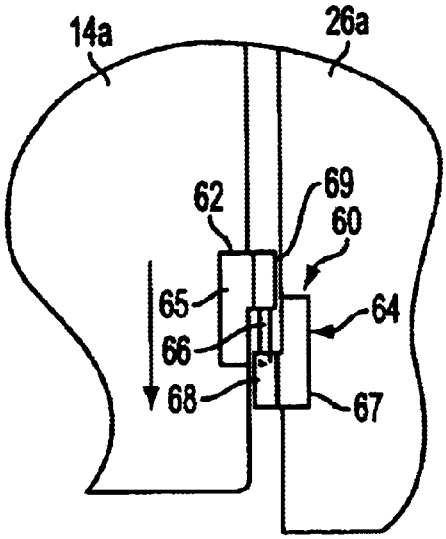
FIG. 5 is an enlarged detail view illustrating a hinge assembly for the transportable medical cart.

The top panel, the left and right side panels and the left and right extension panels are removably mounted on the frame assembly via hinge assemblies 60 shown in FIG. 5. Each hinge assembly 60 includes a first hinge part or pin part 62 secured to one of the frame assembly or the panel and a complementary second hinge part or sleeve part 64 secured to the other of the frame assembly or the panel. By way of example, FIG. 5 shows the pin part 62 secured along a rearward edge of the left side panel 14*a* and shows the sleeve part 64 secured to the left back upright 26*a*. The pin part 62 includes a hinge plate 65 secured to one of the frame assembly or the panel and a protruding pin member 66 connected to the hinge plate 65. In FIG. 5, the hinge plate 65 is secured to the inner surface of the left side panel 14*a* adjacent its rearward edge, with the pin member 66 protruding downwardly parallel to the rearward edge of the left side panel. The sleeve part 64 includes a hinge plate 67 secured to the other of the frame assembly or the panel and a sleeve or passage defining member 68 connected to the hinge plate 67, with an entry opening of the sleeve member oriented to receive the pin member 66 of pin part 62. In FIG. 5, the hinge plate 67 is secured to the outer planar surface of the left back upright 26*a* with the entry opening of sleeve member 68 facing upwardly. The pin part and sleeve part are assembled to form the hinge assembly by aligning the pin member 66 with the entry opening of the sleeve member 68 and inserting the pin member into the sleeve member as far as possible. As shown by the arrow in FIG. 5, the left side panel 14*a* is moved downwardly to insert the pin member 66 into the sleeve member 68 as far as possible. In an assembled hinge assembly, the mating or releasably engaged pin part and sleeve part are rotatable relative to one another, with the pin member being rotatable within the sleeve member and/or the sleeve member being rotatable around the pin member. In the preferred embodiment, the hinge plates are made from aluminum and are welded to the frame assembly and the panels, respectively. The pin members are made of stainless steel and are secured in retention sleeves 69 attached to hinge plates 65.

For the sake of simplicity, the transportable medical cart is illustrated herein with all of the first hinge parts or pin parts 62 secured to the removable panels and all of the second hinge parts or sleeve parts 64 secured to the frame assembly. However, it should be appreciated that any or all of the pin parts can be secured to the frame assembly with the complementary sleeve parts secured to the removable panels. In the preferred embodiment, two sleeve parts 64 are mounted at horizontally spaced locations on the upper back cross member 30*a*, two sleeve parts 64 are mounted at vertically spaced locations on each of the left back and right back uprights 26*a* and 26*b* and two sleeve parts 64 are mounted at horizontally spaced locations on each of the upper left and upper right cross members 32*a* and 32*b*. The hinge plates for the sleeve parts on the upper left and upper right cross members are mounted on spacers interposed between the hinge plates and the upper left and upper right cross members. The spacers ensure that the hinge parts complementary to those on the extension panels are spaced the proper distance laterally from the outer surfaces of the upper left and upper right cross members, so that the extension panels can hang vertically over the side panels as explained further below. The hinge assemblies are preferably aluminum slip hinges such as those sold by McMaster Carr, and are welded to the frame assembly and the removable panels.

The top panel 18 is planar and has a rectangular configuration with rounded, laterally extending protrusions 70 at the left and right front corners thereof as best shown in FIG. 3. A pair of pin parts 62, which may be called top panel hinge parts, are mounted on a lower surface of top panel 18 at horizontally spaced locations adjacent the back edge thereof. The top panel hinge parts are complementary to the sleeve parts 64, which may be called top panel complementary hinge parts, on the upper back cross member 30*a*. When the pin members of the top panel hinge parts are fully inserted in the sleeve members of the top panel complementary hinge parts, respectively, the top panel 18 will be pivotally mounted to the frame assembly and can be pivoted or rotated to be disposed horizontally over the upper cross members perpendicular to the back panel. The top panel may include one or more stop members protruding from a lower surface thereof to contact one or more of the upper cross members when the top panel is oriented horizontally over the upper cross members, the one or more stop members ensuring proper horizontal positioning of the top panel over a top of the frame assembly. In addition or alternative thereto, one or more stop members can be provided on one or more of the upper cross members. In the preferred embodiment, the top panel is made of aluminum with a width of about 29.25 inches including protrusions 70, a depth of about 23 inches between front and back edges and a thickness of about 0.190 inch.

Figure 6:
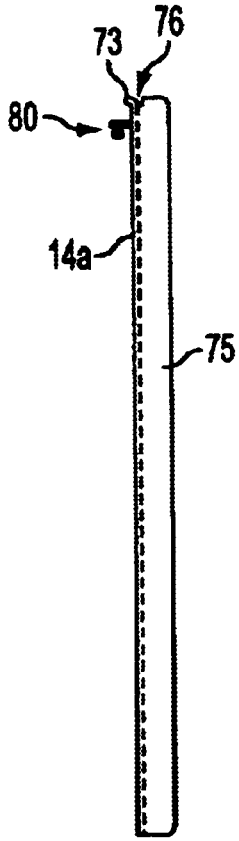
FIG. 6 is a front view of a left side panel for the transportable medical cart.
Figure 7:
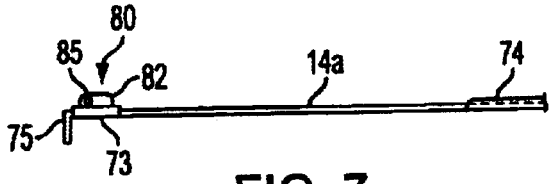
FIG. 7 is a top view of the left side panel.
Figure 8:
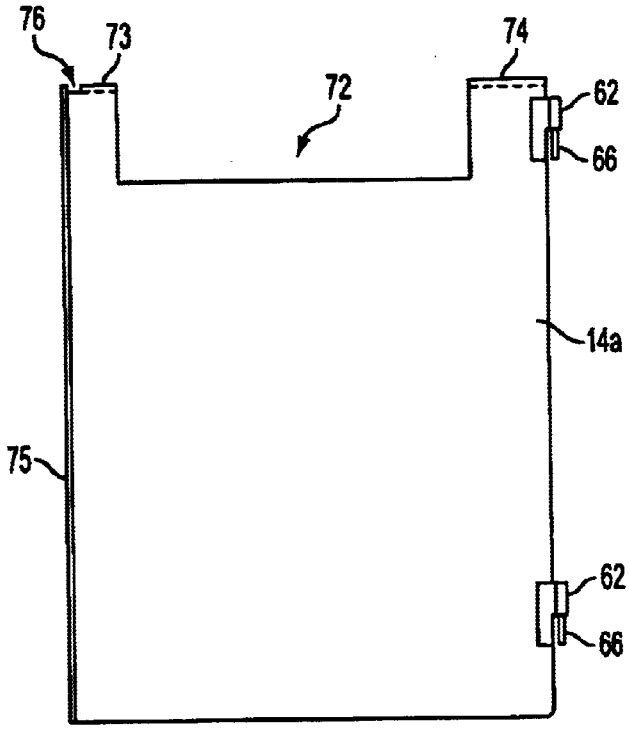
FIG. 8 is a side view of the left side panel.

The left side panel 14*a* is shown in FIGS. 6–8 and has an upper edge with a rectangular cut-out or slot 72 between forward and rearward upper edge segments 73 and 74, respectively, a lower edge, a rearward edge and an inwardly angled front flange 75. The rearward upper edge segment 74 curves laterally or angularly outwardly, i.e., to the left looking at FIGS. 3 and 6, and a portion of the forward upper edge segment 73 between the cut-out 72 and a notch 76 curves laterally or angularly outwardly in the same direction as the rearward upper edge segment. A pair of pin parts 62, which may be called left side panel hinge parts, are mounted to the inner surface of the left side panel 14*a* at vertically spaced locations along the rearward edge thereof as shown in FIG. 8. The left side panel hinge parts have their hinge plates secured to the inner surface of side panel 14*a* so that the pin members 66 extend downwardly. The pin members of the left side panel hinge parts are inserted in the sleeve members, respectively, of the complementary sleeve parts 64, which may be called left side panel complementary hinge parts, on the left back upright 26*a* to removably mount the left side panel 14*a* to the frame assembly. When the pin members of the left side panel hinge parts are fully inserted in the sleeve members of the left side panel complementary hinge parts, the left side panel 14*a* is pivotally mounted to the frame assembly and can be pivoted about a vertical axis through the mating left side panel hinge parts and left side panel complementary hinge parts. The left side panel 14*a* can be pivoted to a retracted position, shown in FIG. 1, disposed vertically over the left uprights and left cross members in a plane perpendicular to the top panel. In this position, the front flange 75 overlaps the front surface of the left front upright 24*a* with a snug fit such that the side panel 14*a* is releasably secured in the retracted position. The cut-out 72 is located such that the sleeve parts 64 on the upper left cross member 32*a* are disposed therein, and the cut-out accommodates protrusion of these sleeve parts by the spacers beyond the outer surface of the upper left cross member 32*a*. One or more stop members can be provided on the left side panel to protrude from the inner surface thereof in order to contact one or more of the left uprights or left cross members when the left side panel is in the retracted position, the one or more stop members ensuring proper vertical positioning of the left side panel over a left side of the frame assembly. In addition or alternative thereto, one or more stop members can be provided on one or more of the left uprights or left cross members. The right side panel 14*b* is a mirror image of the left side panel 14*a*, and the pin parts 62 thereof, which may be called right side panel hinge parts, cooperate with the complementary sleeve parts 64, which may be called right side panel complementary hinge parts, on the right back upright 26*b* to pivotally mount the right side panel on the frame assembly.

In the preferred embodiment, the left and right side panels are aluminum panels having a height of about 29.5 inches, a depth of about 21.75 inches, and a thickness of about 0.190 inch. The front flange has an inward extension or width of about 1.38 inches. The laterally curved or angled portion of the forward upper edge segment has a lateral extension or width of about 0.437 inch, and the laterally curved or angled rearward upper edge segment has a lateral extension or width of about 0.375 inch. The laterally curved or angled portion of the forward upper edge segment extends about 1.56 inches forwardly from the cut-out, and the rearward upper edge segment extends rearwardly from the cut-out about 3.50 inches. The cut-out has a height of about 4.5 inches and a length between the forward and rearward upper edge segments of about 15.75 inches. The notch has a height of about 0.25 inch.

Figure 9:
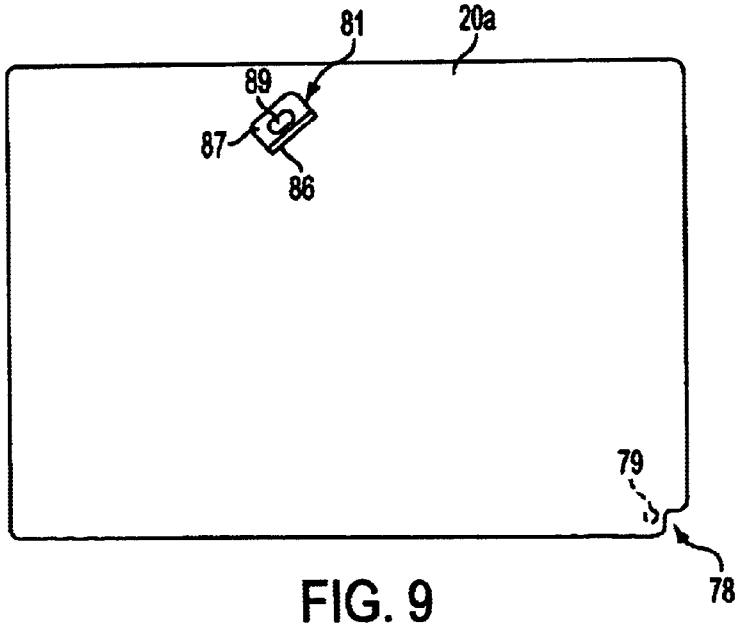
FIG. 9 is a top view of a left extension panel for the transportable medical cart.

The left extension panel 20*a* is illustrated in FIG. 9 and is a planar panel having a rectangular configuration with left and right side edges and forward and rearward edges. The right front corner of the left extension panel 20*a* has a rounded recess 78 therein for accommodating the protrusion 70 at the left front corner of top panel 18. The left front corner and the rear corners of the left extension panel 20*a* are rounded so as not to present any sharp or pointed edges or corners. As shown in FIG. 3, pin parts 62, which may be called left extension panel hinge parts, are mounted on a lower surface of left extension panel 20*a* at horizontally spaced locations along its right side edge. The pin members of the left extension panel hinge parts cooperate with the sleeve members of the complementary sleeve parts 64, which may be called left extension panel complementary hinge parts, on the outer surface of the upper left cross member 32*a* to pivotally mount the left extension panel on the frame assembly. When the pin members of the left extension panel hinge parts are fully inserted in the sleeve members of the left extension panel complementary hinge parts, the right side edge of the left extension panel 20*a* extends alongside the left side edge of top panel 18. The recess 78 mates with the protrusion 70 of top panel 18, and the extension panel 20*a* can be pivoted or rotated about a horizontal axis through the mating left extension panel hinge parts and left extension panel complementary hinge parts to a non-extended position as shown in FIG. 1. In the non-extended position, the left extension panel 20*a* hangs from the left extension panel complementary hinge parts and extends vertically over the left side panel 14*a* in the retracted position, the left extension panel in the non-extended position being perpendicular or substantially perpendicular to the top panel and being parallel or substantially parallel to the left side panel in the retracted position. A stop member 79, shown in dotted lines in FIG. 9, is secured in a hole in the lower surface of the left extension panel 20*a* and protrudes from the lower surface thereof to act as a stop or abutment for the left extension panel against the left side panel, the stop member ensuring proper vertical positioning of the left extension panel in the non-extended position. The right extension panel 20*b* is a mirror image of the left extension panel 20*a*, and the pin parts 62 thereof, which may be called right extension panel hinge parts, cooperate with the complementary sleeve parts 64, which may be called right extension panel complementary hinge parts, on the upper right cross member 32*b* to pivotally mount the right extension panel on the frame assembly. In the preferred embodiment, the left and right extension panels are aluminum panels having a rectangular configuration with rounded corners and a width of about 16.5 inches, a depth of about 22.75 inches and a thickness of about 0.187 inch.

Figure 13:
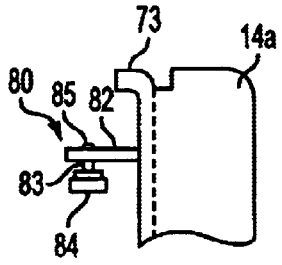
FIG. 13 is an enlarged fragmentary view of a releasable lock of a securing mechanism for the transportable medical cart.
Figure 14:
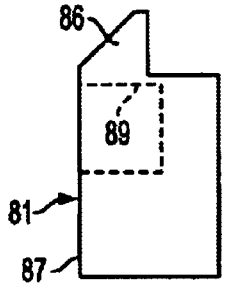
FIG. 14 is a side view of a securing bracket of the securing mechanism.

A securing mechanism is provided for each pair of side and extension panels and includes a releasable lock 80, shown in FIGS. 3, 6, 7 and 13, and a securing bracket or catch 81, shown in FIGS. 3, 9 and 14, for releasably retaining or securing the lock 80. A lock 80 is mounted on each side panel 14*a* and 14*b* as shown in FIG. 3 for the right side panel 14*b* and in FIGS. 6, 7 and 13 for the left side panel 14*a*. Each lock 80, as best seen in FIGS. 7 and 13, includes a planar bracket 82 attached to the outer surface of the corresponding side panel and extending perpendicular therefrom. The bracket 82 is disposed a short distance below the forward upper edge segment 73 of the side panel in vertical alignment therewith. Each lock 80 also includes a locking pin 83 press fit into a hole in bracket 82. The locking pin 83 extends transverse or perpendicular to bracket 82 and has a lower end formed or provided with a knob 84 beneath the bracket 82 and an upper end 85 spring biased to a closed or lock position protruding above bracket 82. The locking pin 83 is vertically movable within bracket 82, and the spring bias allows the locking pin to move downwardly from the lock position to an open or release position when a downward force is applied thereto. Upon removal of the downward force, the spring bias causes the locking pin 83 to automatically return to the lock position. Preferably, the bracket 82 is made of aluminum about 0.125 inch thick and has an oblong configuration about 0.625 inch wide and about 1.250 inches long. The bracket is preferably welded to the corresponding side panel. The locking pin is preferably a stainless steel spring closed actuating pin.

A securing bracket 81 is mounted on the lower surface of each extension panel 20*a* as and 20*b* as shown in dotted lines in FIG. 3. As best illustrated in FIG. 9 for the left extension panel 20*a* and in FIG. 14, the securing bracket 81 has an angled ramp 86 joined to a body 87 having a recess or cavity 89 therein. The securing bracket 81 is oriented at an angle such that, when the corresponding extension panel is in the extended position, the recess 89 is in the path of movement of the locking pin 83 when the corresponding side panel is moved to the non-retracted position. The ramp 86 is angled from the body 87 so that the locking pin of the corresponding side panel engages and moves over the ramp and is thereafter aligned with the recess 89 when the corresponding side panel is moved to the non-retracted position as explained further below. The securing bracket is preferably made from machined aluminum and is welded to the lower surface of the corresponding extension panel.

Figure 10:
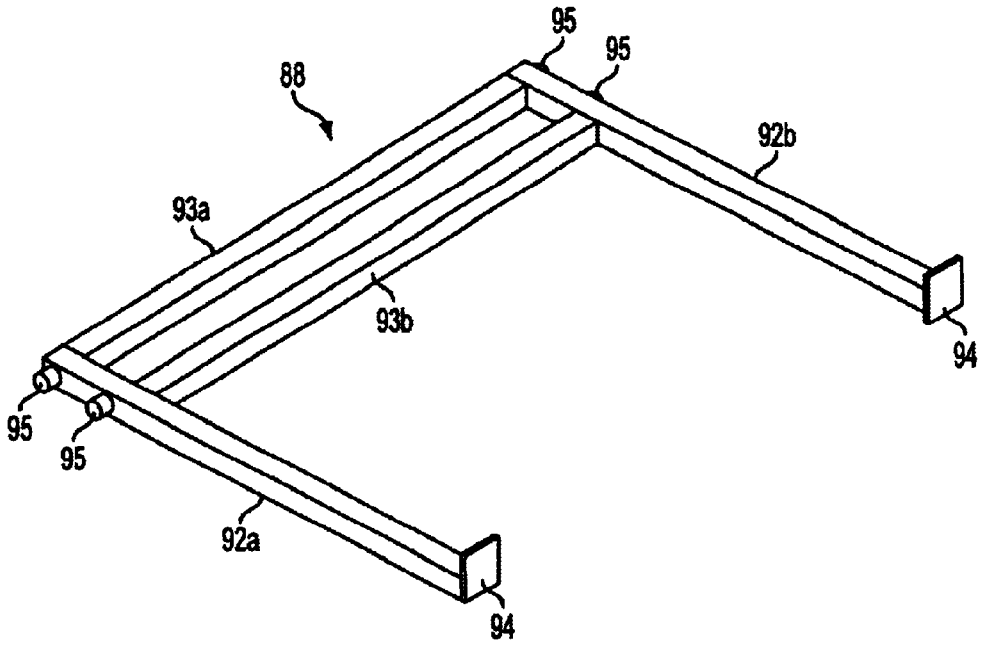
FIG. 10 is a front perspective view of a slide rail for the transportable medical cart.

Each drawer assembly 22 includes a slide rail 88 and a drawer or container 90 for being supported by the slide rail 88. The slide rail 88 is illustrated in FIG. 10 and includes left and right side rails 92*a* and 92*b* joined by a pair of cross rails 93*a* and 93*b*. The left and right side rails 92*a* and 92*b* are parallel to one another and perpendicular to the cross rails 93*a* and 93*b* The left and right side rails 92*a* and 92*b* each have forward and rearward ends, the rearward ends being joined by the cross rail 93*a*, which may be considered a rearward cross rail. The cross rail 93*b*, is spaced forwardly of the cross rail 93*a* parallel therewith and may be considered a forward cross rail. The forward ends of the left and right side rails have planar end flanges 94 thereon, respectively, each protruding upwardly and inwardly beyond the external dimension of the corresponding side rail end to define a stop or abutment for the associated drawer. The left and right side rails each have a pair of bearing bosses 95, i.e. a rear bearing boss and a forward bearing boss, mounted in holes, respectively, at longitudinally spaced locations along the outer faces or surfaces of the side rails. The bearing bosses 95 protrude laterally outwardly in a perpendicular direction from the outer surfaces of the left and right side rails for insertion in the guide channels 38 of a cooperating pair of guide rails 36*a*, 36*b* as explained further below. The slide rail 88 has a width between the outer surfaces of the left and right side rails allowing forward and rearward sliding movement of the slide rail between a cooperating pair of guide rails 36*a*, 36*b* when the bearing bosses of the left and right side rails are slidably received in the guide channels of the cooperating pair of guide rails. The slide rail 88 has a depth between the end flanges and the rearward ends of the left and right side rails for accommodation within the depth of the interior of the frame assembly when the slide rail is moved or slid rearwardly as far as possible, as limited by engagement of the rear bearing bosses 95 with the rearward ends of the guide channels 38. The slide rail defines a drawer receiving space having a width between the side rails and a depth between the end flanges and the rear cross rail.

In the preferred embodiment, the left and right side rails and the forward and rearward cross rails are made of one inch square aluminum tube having a wall thickness of 0.125 inch. The forward and rearward cross rails are about 21.75 inches long. The left and right side rails are about 20.88 inches long with counter sunk holes in their rearward ends for receiving the bearing bosses, which are cylindrical and have an external diameter of about 0.625 inch. The end flanges are made of aluminum plate about 3/15 inch thick and have a height of about 2 inches and a width of about 1.25 inches. Each end flange has a lower edge aligned with a bottom surface of the corresponding side rail, an outer side edge aligned with the outer surface of the corresponding side rail and an inner side edge disposed about 0.25 inch from an inner surface of the corresponding side rail. Ends of the forward and rearward cross rails are welded to the inner surfaces of the left and right side rails, and the end flanges are welded to the forward ends of the left and right side rails. In the preferred embodiment, four slide rails 88 are provided in the transportable medical cart, one for each pair of cooperating left and right guide rails.

Figure 11:
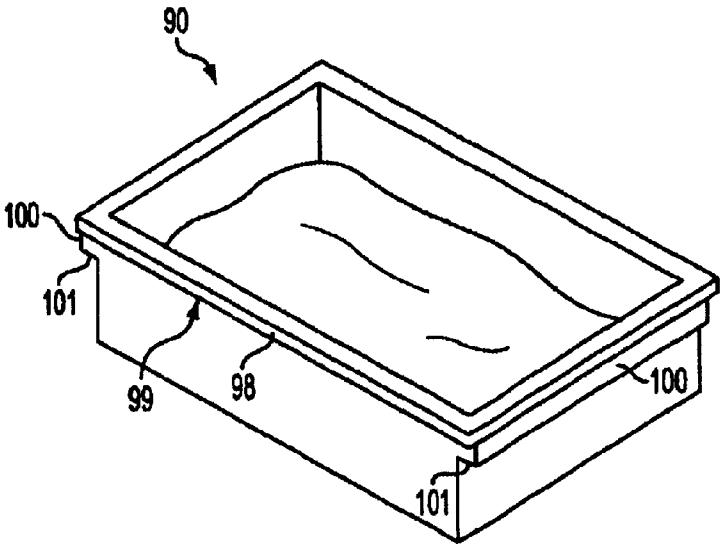
FIG. 11 is a front perspective view of a drawer for the transportable medical cart.

FIG. 11 illustrates a drawer or container 90 for drawer assembly 22. The drawer 90 has an outwardly protruding peripheral rim or lip 98 along its upper edge, the rim or lip forming a peripheral, undercut channel 99 facilitating grasping of the drawer. The drawer has side shoulders 100 extending, respectively, along opposite or left and right sides thereof. The shoulders 100 extend downwardly from the channel 99 and define horizontal, bottom planar surfaces 101, respectively, by which the drawer is supported on the upper surfaces of the left and right side rails, respectively, of slide rail 88. The drawer has a lower portion or base extending downwardly from planar surfaces 101 to a bottom, the base having a width and depth to be received in the drawer receiving spaces of the slide rails with a close fit. The drawer has a height between its bottom and its upper edge; and, typically, a plurality of drawers 90 of different heights will be provided in the transportable medical cart. The drawer 90 is supported on a slide rail 88 with the width of its base disposed between the left and right side rails of the slide rail and the depth of its base disposed between the end flanges and the forward cross rail of the slide rail with the side shoulders supported by gravity on the left and right side rails, respectively. Forward movement of the drawer relative to the slide rail is limited via engagement of the front ends of shoulders 100 with the end flanges 94, respectively. Rearward movement of the drawer relative to slide rail is limited via engagement of the base with the forward cross rail. In the preferred embodiment, four drawers 90 are provided, one for each slide rail 88, with one drawer having a height of 4 inches, two drawers having a height of six inches and one drawer having a height of 10 inches.

The transportable medical cart 10 is easily assembled in a matter of minutes as represented by dotted lines in FIG. 3. Initially, the top panel 18 is assembled to the frame assembly 12 by aligning the top panel hinge parts with the top panel complementary hinge parts on the upper back cross member 30*a*. The pin members of the top panel hinge parts are inserted in the sleeve members of the top panel complementary hinge parts, and the top panel is moved toward the right, looking at FIG. 3, to introduce the pin members as far as possible into the sleeve members. The top panel is pivoted so that it is oriented horizontally over the top of the frame assembly perpendicular to the back panel.

One of the side panels 14*a* or 14*b* is assembled next, by aligning the pin members of its side panel hinge parts with the sleeve members of the side panel complementary hinge parts on the corresponding back upright. For the left side panel 14*a*, for example, the pin members of the left side panel hinge parts are aligned with the sleeve members of the left side panel complementary hinge parts on the left back upright 26*a*. The left side panel 14*a* is moved downwardly to introduce the pin members as far as possible into the sleeve members, and the left side panel is pivoted to the retracted position. With the top panel oriented horizontally and the left side panel 14*a* in the retracted position, the top panel 18 cannot move to the left, looking at FIG. 3, to disengage the top panel hinge parts from the top panel complementary hinge parts.

When the transportable medical cart is being assembled by one person, it is most efficient to assemble the side and extension panels on one side of the frame assembly and to thereafter assemble the side and extension panels on the opposite side of the frame assembly. Accordingly, where the left side panel 14*a* has just been assembled to the frame assembly, the left extension panel 20*a* will be assembled to the frame assembly next. The pin members of the left extension panel hinge parts are aligned with the sleeve members of the left extension panel complementary hinge parts on the upper left cross member 32*a*, the left extension panel complementary hinge parts being accessible through the cut-out in the left side panel 14*a*. Of course, it is possible for the left side panel to be pivoted outwardly from the retracted position to facilitate assembly of the left extension panel. The pin members of the left extension panel hinge parts are inserted in the sleeve members of the left extension panel complementary hinge parts, and the left extension panel 20*a* is moved rearwardly, looking at FIG. 3, to introduce the pin members in the sleeve members as far as possible. With the left side panel 14*a* in the retracted position, the left extension panel is pivoted downwardly to the non-extended position. In the non-extended position, the left extension panel 20*a* cannot move forwardly to inadvertently disengage the left extension panel hinge parts from the left extension panel complementary hinge parts, since forward movement of the left extension panel is limited by the protrusion 70 at the left front corner of top panel 18 received in the recess 79 of the left extension panel. The right side panel 14*b* is then assembled to the frame assembly 12 in a manner similar to that described above for the left side panel 14*a*. Thereafter, the right extension panel 20*b* is assembled to the frame assembly 12 in a manner similar to that described above for the left extension panel 20*a*. With the left and right side panels in the retracted position, the left and right side panels are disposed vertically along the left and right sides, respectively, of the frame assembly in parallel planes, respectively, perpendicular to the top panel. The left and right extension panels in the non-extended position are disposed vertically over the left and right side panels, respectively, parallel or substantially parallel thereto.

Drawer assemblies 22 are assembled to frame assembly 12 by grasping a slide rail 88 and inserting its rear bearing bosses 95 in the mouths 45 of the insertion passages 44 of the guide channels 38 of a cooperating pair of guide rails 36*a* and 36*b*, respectively. The slide rail 88 is manipulated to move the rear bearing bosses downwardly in the insertion passages and into the guide channels 38, respectively, with which the insertion passages communicate. The slide rail 88 is moved rearwardly to move or slide the rear bearing bosses rearwardly in the guide channels 38, respectively, and is pivoted to align the forward bearing bosses 95 with the mouths 45, respectively. The slide rail 88 is moved rearwardly and pivoted such that the forward bearing bosses enter and move downwardly in the insertion passages and into the guide channels 38, respectively, at which time the slide rail will be supported by the cooperating pair of guide rails. The slide rail 88 is slidable forwardly and rearwardly relative to the frame assembly via sliding of the bearing bosses in the guide channels, respectively. The slide rail 88 is in a fully withdrawn position when the forward bearing bosses engage the forward ends of the guide channels, respectively, which limit forward travel of the slide rail. Also, the forward bearing bosses frictionally engage the outer side wall portions 49, respectively, at the forward ends of the guide channels such that the slide rail is maintained in the fully withdrawn position. The slide rail in the fully withdrawn position cannot be inadvertently disengaged from the guide rails since the forward bearing bosses are not aligned with the insertion passages. FIG. 2 illustrates the lowermost slide rail 88 in the fully withdrawn position. The slide rail 88 is movable or slidable rearwardly from the fully withdrawn position when a manual closing force is applied thereto sufficient to overcome the retaining force of the forward internal bearings defined by the wall portions 49. The slide rail is in a fully inserted position when moved rearwardly as far as possible so that the rear bearing bosses engage the rearward ends of the guide channels. Also, the rear bearing bosses frictionally engage the outer side wall portions 50 at the rearward ends of the guide channels, respectively, such that the slide rail is retained in the fully inserted position. The slide rail is movable or slidable forwardly from the fully inserted position when a manual opening force is applied thereto sufficient to overcome the retaining force of the rearward internal bearings defined by wall portions 50.

When the slide rail 88 is in the fully withdrawn position, a drawer 90 can be assembled therewith. The upper edge of the drawer is grasped along its sides, as facilitated by the peripheral rim 98 and channel 99, which accommodates the finger tips of the hands used to grasp the drawer. The drawer is disposed over the slide rail in alignment with the drawer receiving space, and is lowered vertically or straight downwardly into the drawer receiving space until the planar surfaces 101 abut the upper surfaces of the left and right side rails 92*a* and 92*b*, respectively, at which time the drawer is supported by gravity on the slide rail and can be released. The base of the drawer is laterally confined between the side rails, thereby limiting lateral movement of the drawer relative to the slide rail. Forward and rearward movement of the drawer is limited by the end flanges 94 in engagement with the front ends of the shoulders 101, respectively, and by the forward cross rail 93*b* in engagement with the back of the base of the drawer. The configuration of the drawer in relation to the slide rail prevents the drawer from moving any significant amount in the lateral and forward and rearward directions. FIG. 2 illustrates the lowermost drawer support on the lowermost slide rail, and shows the lowermost drawer in a fully withdrawn position corresponding to the fully withdrawn position of the lowermost slide rail.

Once the drawer is supported on the slide rail, the upper edge of the drawer is manually grasped along a front side thereof, as facilitated by the peripheral lip 98 and channel 99, which accommodates the finger tips of a hand. The drawer is pushed rearwardly to move the slide rail to the fully inserted position, at which time the drawer is in a fully inserted position corresponding to the fully inserted position of the slide rail. The procedure is repeated for all of the slide rails and drawers. FIG. 1 shows all of the slide rails and drawers in the fully inserted position. The drawers are movable from their fully inserted position to their fully withdrawn or any partially withdrawn position by grasping the upper edges of the drawers along their front sides and pulling the drawers forwardly, causing corresponding movement of the slide rails therewith due to abutment of shoulders 100 with end flanges 94. The drawers are moved from their fully withdrawn or any partially withdrawn position to their fully inserted or any partially inserted position by grasping the upper edges of the drawers along their front sides and pushing them rearwardly, causing corresponding movement of the slide rails therewith due to engagement of the bases of the drawers with the forward cross rails 93*b*.

It should be appreciated that the drawers can be arranged as desired in the transportable medical cart. As illustrated in FIG. 1 for the preferred embodiment, the four inch high drawer is assembled to the uppermost slide rail, the six inch high drawers are assembled to the upper and lower intermediate slide rails, respectively, and the ten inch high drawer is assembled to the lowermost slide rail. However, by way of an example, the ten inch high drawer can be assembled on the uppermost slide rail, allowing the upper and lower intermediate slide rails to be used to support any two of the remaining drawers.

When the slide rails and drawers are in the fully inserted position as shown in FIG. 1, the minimal vertical gap or space between the bottoms and tops of adjacent drawers and between the uppermost drawer and the top panel ensures that the contents of each drawer is protected regardless of whether the drawers are provided with optional covers or lids. The drawers in the fully inserted position are disposed entirely within the interior of frame assembly 12 but are accessible via the open front of the frame assembly. With the drawers in the fully inserted position as shown in FIG. 1, the outer dimensions of the transportable medical cart provide a relatively small "footprint" conducive to being stored in relatively small areas or spaces, such as a closet of a patient's hospital room. In the preferred embodiment, the transportable medical cart has a "footprint", including the caster pads, that is about 30.75 inches wide and about 24 inches deep. In the preferred embodiment, the transportable medical cart is 34 inches high, which is optimal for child-birth procedures. For surgical procedures, the cart can be about 38 to 40 inches in height, which corresponds to standard operating or back table height.

The transportable medical cart 10, in a sanitized condition, is typically located proximate its anticipated site of use. For example, the cart can be located in a surgical suite, an operating room or a patient's hospital room. When used in a hospital setting, the cart is typically prepared for use by being loaded with pre-packed drawers or containers brought to the cart from a central supply unit of the hospital. The drawers or containers are pre-packed in the central supply unit with all of the medical supplies or equipment needed to perform a particular medical procedure or case, such as a labor and delivery procedure. The pre-packed drawers, which may be considered kits, are completely sterile to medical standards and are typically loaded into the sterile cart by a medical technician. The cart is then stored until the medical procedure for which it is prepared is ready to be performed. Where the cart is prepared for a labor and delivery procedure, the drawers typically contain items such as small instruments, surgical packs, basins, sanitization containers, larger instrument kits, secondary support items, and sterile robes and drapes. A cart prepared for a labor and delivery procedure can be stored in a closet of the maternity patient's hospital room and can be removed from the closet as delivery becomes imminent.

Figure 12:
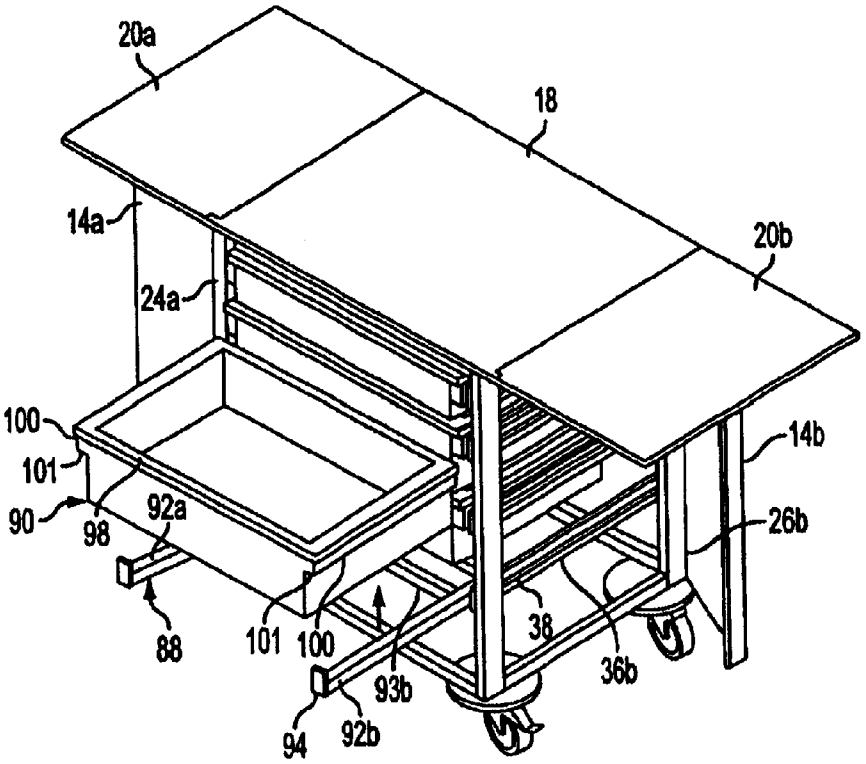
FIG. 12 is a front perspective view of the transportable medical cart illustrating removal of the lowermost drawer.

When the transportable medical cart 10 is ready to be used, it is brought to the site of use, and the medical supplies or equipment needed for the procedure being performed are removed from the drawers. Typically, the medical equipment will be removed from the cart by a nurse, who grasps the rim at the front side of a selected drawer and pulls the drawer forwardly. As the drawer is pulled forwardly, its slide rail is also pulled forwardly, and the drawer can be moved to the fully withdrawn position shown in FIGS. 2 and 12 or to any partially withdrawn position to access the contents of the drawer. Usually, the selected drawer will be removed from the cart to facilitate removal of its contents, in which case the selected drawer and slide rail are moved to the fully withdrawn position. As shown in FIGS. 2 and 12 for the lowermost drawer and slide rail, the drawer is externally of the frame assembly, and the back of the drawer clears or is disposed forwardly of the fronts of the drawers above it when in the fully withdrawn position. Accordingly, the rim of the fully withdrawn drawer can be grasped along the sides of the drawer, and the drawer can be raised or lifted vertically or straight upwardly off of its slide rail for removal from the cart as shown by the arrow in FIG. 12 for the lowermost drawer. When a selected drawer has been removed from the cart, it can be placed on the top panel while the contents thereof are removed, and the medical equipment removed from a selected drawer can be placed on the top panel.

In many medical procedures, it is desirable to provide a larger work space for supporting medical equipment and/or by-products of the medical procedure, and/or to provide a table for supporting a patient. The transportable medical cart 10 can be converted to an operating table providing increased work space for medical equipment and/or by-products of a medical procedure, and/or to support a patient. The transportable medical cart 10 is converted to an operating table by pivoting one of the left or right extension panels upwardly, about the horizontal axis through the mating extension panel and extension panel complementary hinge parts, from the non-extended position to an extended position wherein the extension panel is horizontally aligned with the top panel as shown in FIG. 2. While the extension panel is manually held in the extended position, the corresponding side panel is pivoted outwardly, about the vertical axis through the mating side panel and side panel complementary hinge parts, from the retracted position to a non-retracted position shown in FIG. 2, the side panel being grasped and moved outwardly from the frame assembly with sufficient force to overcome the snug fit of the front flange with the corresponding front upright. The side panel is pivoted outwardly from the frame assembly and is moved to the non-retracted position, at which time the side panel is disposed at an acute angle to the plane of the side panel in the retracted position. As the side panel is moved to the non-retracted position, the locking pin 83 therefor engages and moves over the ramp 86 of the securing bracket 82 for the corresponding extension panel, since the securing bracket 82 is in the path of movement of the locking pin 83 as the side panel is moved toward the non-retracted position. As the locking pin engages and moves over the ramp 86, a camming force is applied to the locking pin causing it to move downwardly toward the release position. The locking pin 83 is thereby permitted to move across the ramp 86 and into alignment with the recess 89. Once the locking pin has cleared ramp 86 and is aligned with recess 89, the camming force on the locking pin is removed. The locking pin automatically returns to the lock position, and the upper end 85 thereof enters recess 89. Accordingly, the side panel in the non-retracted position is releasably locked to the corresponding extension panel in the extended position. The same procedure is repeated for the other extension panel and the other side panel, at which time the transportable medical cart 10 will be converted to an operating table as shown in FIG. 2. The extension panels 20*a* and 20*b* will be supported on the upper edge segments of the side panels 14*a* and 14*b*, respectively, and will be locked in place. In the preferred embodiment, the operating table defined by top panel 18 and extension panels 20*a* and 20*b* has a width of about 61 inches and a depth of about 21.5 inches.

As shown in FIG. 2, the extension panels can have shaped openings 102 therein for holding various objects, the extension panels 20*a* and 20*b* being shown with optional circular openings 102, respectively, for holding a basin 103. A sterile drape can be positioned over the operating table, and the cart can be turned so that the back panel of the cart faces the physician, with the front of the cart facing the nurse who has access to the drawers throughout the medical procedure.

Upon completion of the medical procedure, all of the medical equipment removed from the cart is typically replaced in the drawers along with body fluids, waste, contaminants or other by-products of the medical procedure.

Where the cart has been draped, the medical equipment and/or by-products can be wrapped in the drape to facilitate their placement in a drawer. Each side panel is released from its corresponding extension panel by grasping the knob 84 of its locking pin and pulling the knob downwardly to move the locking pin from the lock position to the release position. The upper end of the locking pin is thereby removed from the recess of the corresponding securing bracket, allowing the side panel to be manually pivoted back to the retracted position while the corresponding extension panel is manually held in the extended position. Once the side panel has been returned to the retracted position, the corresponding extension panel is pivoted to the non-extended position. Once both side and extension panels have been returned to the retracted and non-extended positions, respectively, the cart is ready to be transported to a cleaning facility. In a hospital setting, the cart is typically wheeled to the hospital's central cleaning facility.

The cart is disassembled, in a matter of minutes, prior to cleaning following a six-point disassembly procedure, which is basically a reversal of the assembly procedure described above. Initially, the top panel 18 is removed from the frame assembly by lifting the front edge of the top panel and pivoting the top panel upwardly about the horizontal axis through the mating top panel and top panel complementary hinge parts a sufficient distance to allow the top panel to be moved to the left, looking at FIG. 2, to disengage the top panel hinge parts from the top panel complementary hinge parts on the upper back cross member. One of the extension panels is removed next by pivoting the extension panel upwardly from the non-extended position about the horizontal axis through the mating extension panel and extension panel complementary hinge parts, and moving the extension panel forwardly, looking at FIG. 2, to disengage the extension panel hinge parts from the extension panel complementary hinge parts on the corresponding cross member. The side panel on the same side of the frame assembly as the extension panel that has just been removed is then pivoted, about the vertical axis through the mating side panel and side panel complementary hinge parts, to a non-retracted position. The side panel is lifted upwardly to disengage the side panel hinge parts from the side panel complementary hinge parts on the corresponding back upright. The extension panel and the side panel on the opposite side of the frame assembly are then removed in sequence in a similar manner. The slide rails are moved to the fully withdrawn position and their drawers are removed, after which the slide rails are removed from the frame assembly. The slide rails are removed from the frame assembly by first aligning the forward bearing bosses with the insertion passages and pivoting the slide rails to move the forward bearing bosses upwardly from the insertion passages, and then aligning the rear bearing bosses with the insertion passages and manipulating the slide rails to move the rear bearing bosses upwardly from the insertion passages for removal from the guide rails. The frame assembly, the slide rails and, optionally, the drawers are then ready to be sanitized to medical standards for re-use.

With the transportable medical cart, the availability of needed medical supplies at an operative area is insured since the drawers are pre-packed or kitted for a particular medical procedure. Since all of the equipment needed for a particular medical procedure can be provided in the transportable medical cart, medical procedures can be accomplished more efficiently, and the time needed between procedures can be reduced. The drawers can be pre-packed or kitted in accordance with the medical procedure or case, the requirements of a particular physician and/or the needs of a particular patient. The services provided by medical personnel can be provided more efficiently since medical personnel can go from procedure to procedure with the transportable medical carts already on-site and fully equipped for each procedure. The drawers are easily removable and replaceable in the transportable medical cart with straight lifting and lowering motions and without the need for disengaging extraneous hardware. The drawers can be easily rearranged in a transportable medical cart according to the present invention, allowing the drawer of greatest height to be disposed at the top of the cart, as is desirable for many users. Since the drawer of greatest height often holds the heaviest contents, allowing the drawer of greatest height to be disposed at the top of the cart reduces the distance the drawer needs to be lifted or lowered for removal or replacement. The drawers can be designed for re-use via sanitization to medical standards. However, the drawers can also be disposable for single patient use. The tubular members forming the uprights and the cross members can be provided with drain holes for drainage of washing fluid. The drawers can be provided with optional removable lids or covers. The hinge parts can be reversed such that either the pin parts or the sleeve parts can be disposed on the frame assembly. The direction of movement of the various panels needed to engage and disengage the hinge parts during assembly and disassembly can vary depending on the orientation of the hinge parts. The transportable medical cart can be finished in electrostatic paint for enhanced durability and cleanliness.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A transportable medical cart comprising a frame assembly having a plurality of wheels by which said frame assembly is transportable, said frame assembly including a pair of front uprights and a pair of back uprights having upper and lower ends, respectively, an upper front cross member extending perpendicularly between said upper ends of said front uprights, an upper back cross member extending perpendicularly between said upper ends of said back uprights, and a pair of lateral cross-members extending perpendicularly between said upper ends of said front and back uprights, respectively;

a plurality of exterior panels mounted on said frame assembly and including a horizontal top panel, a pair of vertical side panels having a retracted position in which said side panels are disposed on opposite sides of said frame assembly in parallel planes, respectively, perpendicular to said top panel, and a pair of extension panels having a non-extended position in which said extension panels are disposed vertically over said side panels, respectively, in overlapping arrangement with said side panels in said retracted position, said extension panels being pivotally mounted on said frame assembly for movement from said non-extended position to an extended position in which said extension panels are horizontally aligned with said top panel to form an operating table, said side panels being pivotally mounted on said frame assembly for movement from said retracted position to a non-retracted position in which said side panels are moved relative to said extension panels outwardly of said frame assembly at an acute angle to said planes, respectively, to support said extension panels in said extended position;

a plurality of first hinge parts including a first hinge part on said top panel, a first hinge part on each of said side panels and a first hinge part on each of said extension panels, respectively, and a plurality of second hinge parts on said frame assembly in mating engagement with said plurality of first hinge parts, respectively, to pivotally mount said too panel, said side panels and said extension panels on said frame assembly, said plurality of second hinge parts including a second hinge part on said upper back cross member in mating engagement with said first hinge part on said too panel to pivotally mount said top panel on said frame assembly, second hinge parts on said back uprights, respectively, in mating engagement with said first hinge parts on said side panels, respectively, to pivotally mount said side panels on said frame assembly, and second hinge parts on said lateral cross members, respectively, in mating engagement with said first hinge parts on said extension panels, respectively, to pivotally mount said extension panels on said frame assembly, each of said side panels having forward and rearward upper edge segments and a cut-out between said forward and rearward upper edge segments, said second hinge parts on said lateral cross members being disposed within said cut-outs, respectively, when said side panels are in said retracted position; and securing means on said side panels, respectively, for releasably lockingly securing said extension panels in said extended position.

2. A transportable medical cart as recited in claim 1 wherein said forward and rearward upper edge segments of said side panels are angled outwardly to support said extension panels, respectively, thereon in said extended position.

3. A transportable medical cart as recited in claim 2 wherein said side panels have inwardly angled front flanges, respectively, for releasably engaging said front uprights when said side panels are in said retracted position.

4. A transportable medical cart as recited in claim 3 wherein said frame assembly defines an interior and further including a plurality of drawer assemblies removably mounted in said interior.

5. A transportable medical cart as recited in claim 4 wherein said plurality of first hinge parts releasably engage said plurality of second hinge parts, respectively, to removably mount said top panel, said side panels and said extension panels on said frame assembly.

6. A transportable medical cart as recited in claim 5 wherein said frame assembly includes a vertical back panel perpendicular to said top panel and to said side panels when said side panels are in said retracted position.

7. A transportable medical cart as recited in claim 6 wherein said back panel is non-removably mounted to said frame assembly.

8. A transportable medical cart as recited in claim 7 and further including a caster pad attached to said lower ends of said front and back uprights, respectively, and wherein said wheels are mounted beneath said caster pads, respectively, to be protected thereby.

* * * * *